United States Patent [19]

Roy

[11] 4,170,802

[45] Oct. 16, 1979

[54] METHOD OF MANUFACTURING FOOTWEAR

[76] Inventor: Norman A. Roy, Waterville Hill Rd., Norridge Wock, Me. 04957

[21] Appl. No.: 849,346

[22] Filed: Nov. 7, 1977

[51] Int. Cl.[2] ..... A43D 9/00; A43C 13/08

[52] U.S. Cl. ..... 12/142 RS; 36/14

[58] Field of Search ..... 12/142 RS; 36/14

[56] References Cited

U.S. PATENT DOCUMENTS

| | | | |
|---|---|---|---|
| 1,215,449 | 2/1917 | White | 12/142 R S |
| 3,070,909 | 1/1963 | Binder et al. | 36/14 |
| 3,332,097 | 7/1967 | Rollman et al. | 12/142 RS |
| 3,414,989 | 12/1968 | Odermatt | 36/14 |

FOREIGN PATENT DOCUMENTS

| | | | |
|---|---|---|---|
| 149061 | 3/1937 | Austria | 12/142 RS |
| 1249861 | 11/1960 | France | 12/142 RS |
| 2331978 | 6/1977 | France | 36/14 |
| 1197714 | 7/1970 | United Kingdom | 12/142 RS |

*Primary Examiner*—James Kee Chi

*Attorney, Agent, or Firm*—Shoemaker and Mattare, Ltd.

[57] ABSTRACT

There is provided a method of manufacturing a footwear item in which the molded outsole can be firmly affixed to the combination of an upper and an insole. A piece of prime rib tape is bonded to the underside of the insole, placed further inwardly from the edge than is the case in the Goodyear Welt construction, and stitched. The lower free edge of the upper is then stitched to the rib, roughened, and impregnated with bonding cement. Following this the outsole is molded against the underside of the insole so that the outsole contacts and bonds to the roughened region of the upper.

9 Claims, 7 Drawing Figures

METHOD OF MANUFACTURING FOOTWEAR

This invention relates to the manufacture of footwear items, and has to do particularly with the manufacture of footwear such as boots and the like which incorporate a molded sole.

A primary purpose of this invention is to put a covered insole in molded or injected footwear, causing the outsole to bond to the upper and insole.

It is desirable, prior to explaining this invention, to describe the prior art method which is closest to that disclosed herein. This will also be useful for introducing the terminology used in the trade, so that the distinctions between this method and that of the prior art can be made clear.

A well-known method of footwear construction is known as the "Goodyear Welt" (trade mark), utilized primarily in the manufacture of bootwear. These would be primarily men's boots.

In the Goodyear Welt construction, an upper is first formed from outer panels of leather or synthetic material, an inner liner, and if desired a layer of heat-insulative material between the liner and the outer leather panels. The upper would then exhibit a lower free edge with portions corresponding to the toe, the heel and the inside and outside edges. In the case of the provision of a liner, the lower edge would be double.

Next, an insole is provided, to the underside of which is cemented or similarly bonded a length of what is called "prime rib tape", which ordinarily defines a rib, a narrow margin on one side of the rib, and a wide margin on the other side of the rib. This tape is cemented in a position following the edge of the insole at least around the toe end and along both sides, and is positioned such that the rib is located no more than $\frac{1}{4}''$ from the edge of the insole.

In the footwear trade, this distance is always referred to as a certain number of sixteenths, which is identified as margin hereafter. Thus, a distance of one quarter inch would be a "four margin". Normally, the distance between the edge of the insole and the rib is between a 2 and a 4 margin, the distance varying around the different portions of the insole edge.

In the Goodyear Welt construction, the purpose of the rib is to provide a location of attachment between the lower edge of the upper and an additional strip of leather known as the "welt". The rib, in effect, holds the lower edge of the upper in a tightened position around the bottom edge of the insole (stretched because the last is at this time located in the boot), and allows the welt to be affixed to the lower edge of the upper while the latter is stretched in its desired condition. The rib projects downwardly from the insole, and the lower edge of the upper is pressed against the outer side of the rib. Simultaneously, an edge of the welt (which could measure between $\frac{3}{8}''$ and $\frac{5}{8}''$ in width) is laid flush with and flat against the lower edge of the upper, and thus flush with the lower limit of the rib, whereupon all three are stitched together by a machine suited to the purpose.

The boot is thus in a condition in which the upper is stretched down around the last with the lower edge of the upper affixed to the rib, which is in turn affixed to the bottom of the insole by cement, and in which the welt is also stitched into place and extends horizontally outwardly (i.e. in a plane parallel with the insole) all around the boot.

The sole or midsole utilized in the Goodyear Welt construction is a pre-manufactured item, rather than one which is molded in place from polymerizable material such as uncured rubber, PVC or polyurethane. This pre-formed sole or midsole is stitched to the outer or free edge of the welt, again by a machine suited to the purpose, and the end result is that the welt constitutes a bridging member securing the sole or midsole to the lower edge of the upper, and also to the insole by virtue of the cementing of the prime rib tape to the underside of the insole.

It will be understood that, in the Goodyear Welt construction, it is important to set the rib as close as practical to the outer edge of the insole. If the rib were spaced too far away from the edge of the insole, then the welt would not extend radially outwardly far enough for the machine stitching to the outsole to take place. It might be argued that the problem could be overcome by increasing the width of the welt, however this would cause the welt to be a very flimsy and wavy joining member, and the sole of the boot would not be securely affixed to the upper. Moreover, under stress, the sole would pull down and the stitches between the welt and the upper would be visible. This is a very undesirable condition aesthetically. The basic thrust of the present invention is to adapt the provision of the rib on the insole to a manufacturing method which utilizes a molded-in-place outsole, for example from bisquits of uncured rubber, pellets, PVC, polyurethane or any other suitable modable or injectable material.

In conventional methods of construction involving a molded-in-place outsole, the procedure is to utilize nails at the toe and heel and cement elsewhere, applied in a number of sequential steps, for securing the upper to the insole. This prevents the subsequent molded or injected sole material from seeping between the upper and the insole under the pressures used for molding or injection. Following the nailing and cementing, the lower edges of the insole are roughened to receive a cement compatible with the sole material and then the outsole is molded in place.

It is the aim of this invention to provide a simpler method of manufacturing footwear with molded-in-place outsoles, employing the prime rib tape of the Goodyear Welt for a somewhat different purpose than in the latter process.

Accordingly, this invention provides a method of manufacturing a footwear item, comprising the steps:

- assembling an upper having a lower free edge with portions corresponding to the toe, the heel, and the inside and outside edges,
- providing an insole having an underside and a top side,
- bonding to the underside of the insole a length of prime rib tape which defines a rib, and margins on either side of the rib; the tape following the edge of the insole at least around the toe end and along both sides, and being set so that the rib is positioned at least about $\frac{3}{8}''$ in from the insole edge,
- stitching the tape in place along both margins thereof,
- stitching said lower free edge to the rib,
- roughening the lower free edge of the upper to allow cement to be impregnated thereinto,
- applying cement to at least the roughened region,
- and molding an outsole against the underside of the insole so that the outsole contacts and bonds to the roughened region of the upper.

Two embodiments of the method of this invention will be described in the following disclosure, making reference to the accompanying drawings, in which like numerals denote like parts throughout the several views, and in which.

Figure 1:
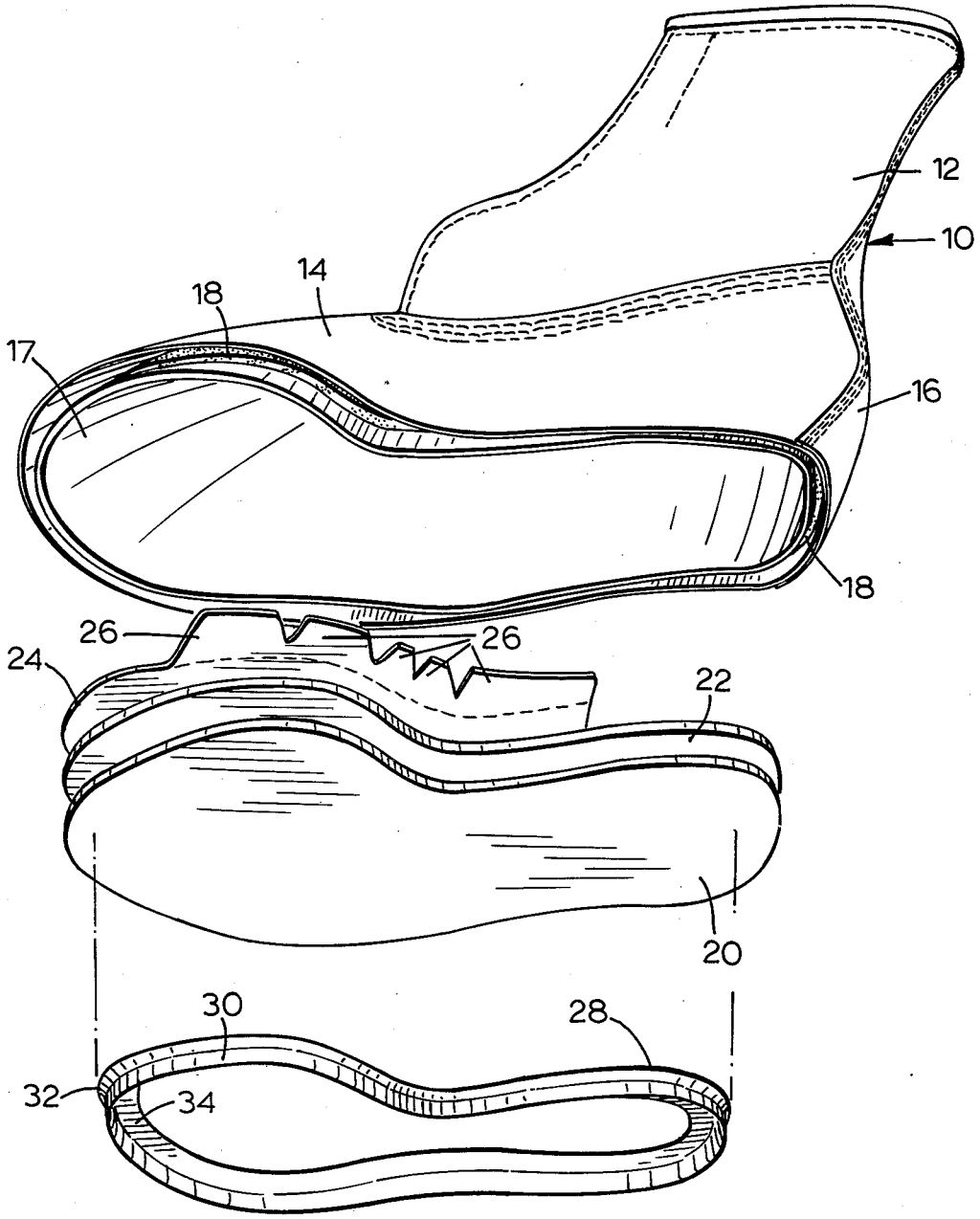
FIG. 1 is an exploded view of an upper, an insole, a pad and cover for the insole, and a rib element prior to assembly, according to the first embodiment.

Attention is first directed to FIG. 1 which shows, in exploded perspective view, an upper 10 consisting of two outer ankle panels 12, an outer toe panel 14, an outer heel reinforcing strip 16, an inner liner 17 and a layer 18 of insulative material. The upper in a construction of this kind would typically also include a tongue portion spanning between the forward edges of the ankle panels 12, but this is not visible from the angle at which FIG. 1 is drawn.

Shown in exploded relation under the upper is an insole 20, a pad member 22 directly above the insole 20 having substantially the same size and profile, and a cover 24 for the insole 20. The cover 24 may be of leather or of synthetic material, and is shaped to conform approximately to the forward portion of the insole 20, with the exception of the heel. In addition, the cover 24 has a plurality of outwardly projecting tabs 26 on both of its sides, the purpose of which will presently appear.

Shown in exploded relation beneath the insole is a piece of prime rib tape 28 which forms a loop configuration and is shaped so as to follow along just inside the edge of the insole 20. The prime rib tape 28 defines, in cross section, a downwardly projecting rib 30, a narrow margin 32 on one side of the rib 30 and a wide margin 34 on the other side of the rib 30.

Figure 2:
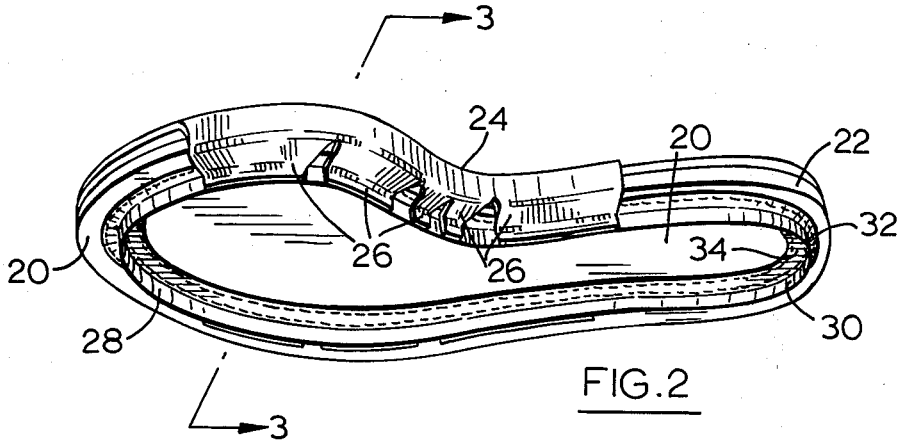
FIG. 2 shows the insole, the pad and the cover of FIG. 1 assembly together.

Following the provision of the components shown in FIG. 1, the length of prime rib tape 28 is bonded to the underside of the insole 20 such that the tape follows the edge of the insole. The tape is set in such a manner that the rib 30 is positioned at least about ⅜" inward from the insole edge. As mentioned previously in this disclosure, distances of this kind are referred to in the trade as a margin of a certain number (sixteenths), and thus the spacing between the rib and the edge of the insole would be referred to as a six margin at least. The bonding of the prime rib tape 28 to the underside of the insole 20 would be done with glue or alternative adhesive, and following the bonding the tape is stitched into place along both of its margins 32 and 34. As can be seen in FIG. 2, there is a single line of stitching along the narrow margin 32, and a double line of stitching along the wide margin 34, the wide margin being inwardly and the narrow margin being outwardly.

Next, the pad member 22 is placed against the insole 20 and adhered thereto if desired, following which the cover 24 is placed against the upper side of the pad member 22 and the tabs 26 on both sides of the cover 24 are wrapped downwardly and inwardly around the side edges of the pad member 22 and the insole 20, so that the marginal portions of the tabs 26 lie against the outer face of the rib 30. The cover 24 would also preferably be bonded or cemented into place against the top side of the pad member 22, and the tabs 26 would likewise be cemented or stapled into place.

Figure 3:
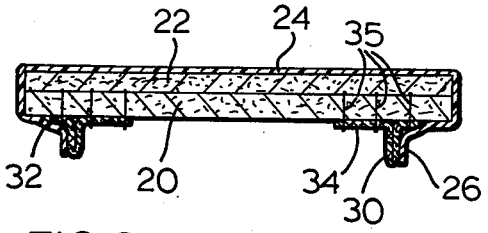
FIG. 3 is a sectional view taken at the line 3—3 in FIG. 2.

FIG. 3 shows a sectional view along the line 3—3 in FIG. 2, and from this figure the juxtaposition of the various components can be clearly seen. The stitching of the margins of the prime rib tape is identified by the numeral 35.

Figure 4:
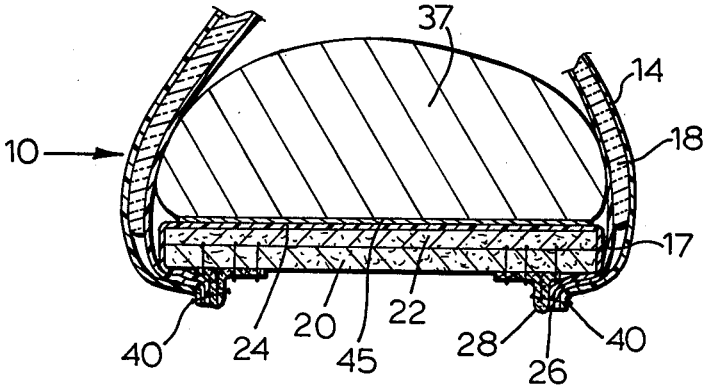
FIG. 4 is a view similar to FIG. 3, but showing the attachment of the upper to the insole.

Following the formation of the component seen in FIG. 2, the same would be tacked to a last, and then the upper 10 would be brought down around the last so that its lower edges, including the lower margins of the toe portion 14 and the liner 17 can wrap downwardly around and under the edges of the composite insole package seen in FIG. 2. In FIG. 4, which is a crosssectional view similar to FIG. 3, the section of the last is seen at numeral 37. The toe panel 14 and the lining 17 of the upper 10 are seen to be pulled down around and under the edge of the insole, and the free edges of these panels are brought into juxtaposition against the tabs 26 of the cover 24, so that the edges of all of these panels lie against the rib 28. Then, these portions are first stapled together to hold them in place during a subsequent stitching operation in which a stitch 40 is inserted to hold these portions firmly in place. The stitch 40 encircles the entire bottom of the boot in the embodiment shown in FIG. 5.

Next, a small number of nails 42 are inserted at the back of the heel, and another group of nails 44 are inserted at the front of the toe, each group of nails passing through the lower free edge of the upper and into the insole 20. The pointed ends of the nails would be clinched by the last 37 which has a steel plate 45 on its lower surface. Alternatively, the nails 42 and 44 could be replaced with staples or any other means providing the requisite strength. There are certain circumstances under which the nails 42, 44 or the equivalent may be dispensed with, and these will be described subsequently.

The next step in the process would involve the roughening of the lower free edge of te upper by using a rotary wire brush or suitable abrasive material for roughening purposes preliminary to the application of cement. The cement would then be applied across the lower surface of the insole 20 and against the roughened portions at the bottoms of the lower free edges of the upper 10. The cement utilized would be one compatible with the material from which the outsole is subsequently molded.

The last step, then, would be the molding of the outsole against the underside of the insole 20 and against the roughened and cemented lower edge portions of the upper 10.

Figure 6:
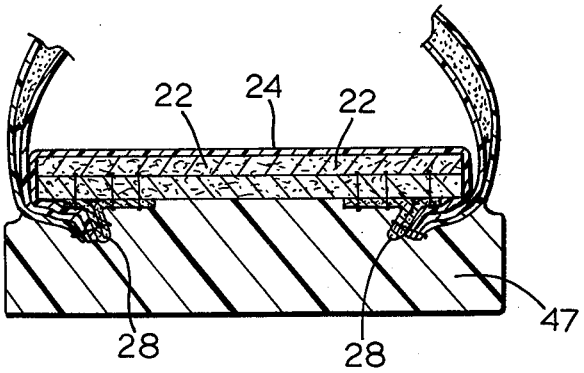
FIG. 6 is a view similar to FIG. 4, showing the outsole molded in place.

In FIG. 6 an outsole 47 is shown in section, the sectional view being similar to that of FIG. 4. It will be seen in FIG. 6 that the pressure of the material of the molded outsole upwardly against the insole 20 has caused a slight bending over and inward of the ribs 28 and the edge portions stitched to the ribs. In FIG. 6 the last 37 has been removed from the final item of footwear. Since the material of the outsole 47 is compatible with the cement previously applied to the insole 22 and the roughened bottom portion of the upper, a good bond is effected between the outsole 47 and the remainder of the shoe or boot.

It will be understood that the provision of the pad member 22 is optional, since it is conceivable that the insole 20 itself could have sufficient softness to be acceptable to the user. It would also be possible to dispense with the cover 24, in the case where the top surface of the insole 20 presented an acceptable texture and smoothness to the foot.

Figure 5:
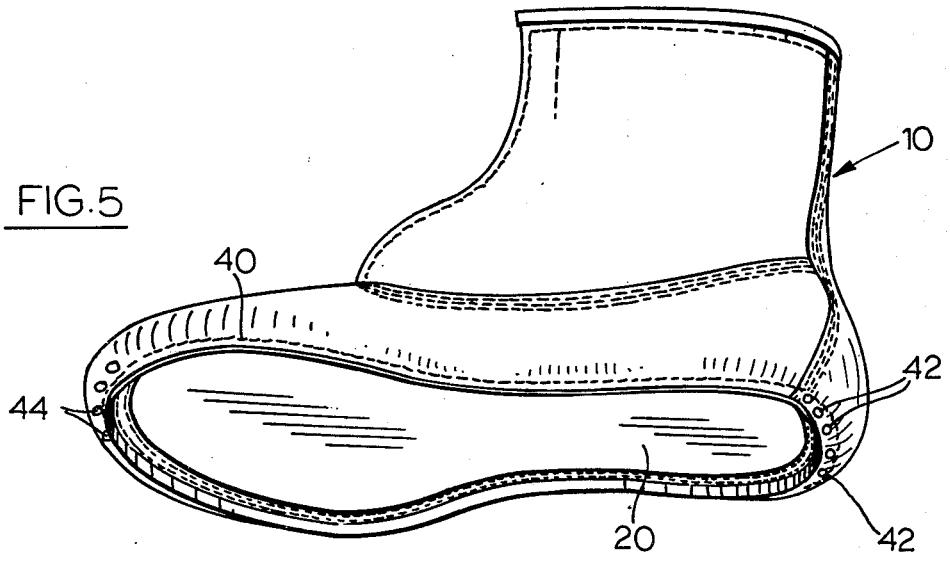
FIG. 5 is a perspective view of the item of footwear just prior to the molding of the outsole.

The provision of the reinforcing members at the back of the heel and the front of the toe, namely the nails 42 and 44 shown in FIG. 5, is intended to reinforce and retain these portions of the boot in place against the upward displacing tendency arising due to the molding procedure. Typically, the outsole 47 would be molded from pre-formed raw rubber bisquits cut to the approximate shape of the bottom of the boot. The bisquits are placed, along with any reinforcing plates or the like, into a molding cavity and the boot is fitted to a metal last which is inserted by the machine downwardly against top of the raw rubber bisquits. The sides and bottom of the molding cavity are movable and these come together and upwardly around the bottom of the boot to compress the raw rubber bisquits against the underside of the other components, and at the same time a high temperature is applied. Typically, a pressure in the region of 800 psi and a temperature around 190° C. are applied to the raw rubber for a period of some eight to fifteen minutes, and this suffices to mold and cure the raw rubber into the desired shape. In FIG. 6, the outsole is shown as a single integral piece of molded rubber, but it is to be understood that various internal provisions such as stiffening plates could also be provided.

It is conceivable, however, that the nails 42, 44 could be dispensed with, or could be replaced by alternative retaining means, which could have the same or a lower degree of strength. It is possible, for example, that the molding conditions could be altered in such a way that the upward pressure against the edges of the insole arising due to the pressure applied to the material being molded for the outsole 47 could be diminished. In such a case, it may not be necessary to add the extra reinforcing means represented by the nails 42, 44.

Figure 5A:
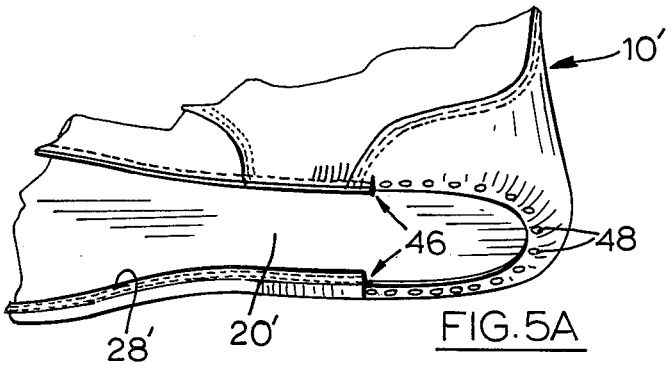
FIG. 5A is a partial perspective view of a boot constructed by the second embodiment of the method of this invention.

In FIG. 5*a*, the result of the second embodiment of the method of this invention is shown. FIG. 5*a* is a partial view similar to FIG. 5. In FIG. 5*a*, the prime rib tape 28 has been applied "breast-to-breast", which is a term in the trade implying that the heel region is not included. As can be seen in FIG. 5*a*, the prime rib tape 28' terminates at locations 46, which represent the forward limit of the heel for the boot. Forward of the locations 46, all of the steps and juxtapositions described earlier in respect of the first embodiment would be exactly the same. However, in the heel portion, in order to secure the lower free edge of the upper against the insole 20', a procedure known in the trade as "heel seat lasting" would take place, in which a number of nails 48 are driven through the lower free edge of the upper and into the insole 20' around the entire periphery of the heel region. No additional reinforcing means for the heel region would be required in this embodiment. In FIG. 5*a* a different arrangement of outer panels for the upper 10' has been shown, but this has no effect on the method of this invention or the boot resulting therefrom.

I claim:

1. A method of manufacturing a footwear item, comprising the steps:

assembling an upper having a lower free edge with portions corresponding to the toe, the heel, and the inside and outside edges, providing an insole having an underside and a top side, bonding to the underside of the insole a length of prime rib tape which defines a rib, and margins on either side of the rib; the tape following the edge of the insole at least around the toe end and along both sides to the heel, and being set so that the rib is positioned at least about ⅜" in from the insole edge, stitching the tape in place along both margins thereof, stitching said lower free edge to the rib, roughening the lower free edge of the upper to allow cement to be impregnated thereinto, applying cement to at least the roughened region, and molding an outsole against the underside of the insole so that the outsole contacts and bonds to the roughened region of the upper, whereby the upper is secured to the outsole by direct bonding while simultaneously being retained by stitching to said tape.

2. The method claimed in claim 1, in which, subsequent to the stitching of the tape to the insole, there is wrapped around the top side of the insole a cover having edge portions which pass around the insole edges and terminate against the rib, the edge portions being then bonded to the rib, whereby when the lower free edge of the upper is stitched to the rib the edge portions of the cover are sandwiched therebetween and are also stitched.

3. The method claimed in claim 1, in which, prior to the stitching of the lower free edge to the rib, these two are fastened together with preliminary fastening means to hold them in place for the stitching operation.

4. The method claimed in claim 1, in which, at a point subsequent to the stitching of the lower free edge and the cover edge portions to the rib but prior to the molding step, reinforcing members are inserted at the back of the heel and the front of the toe through the lower free edge and into the insole, in order to retain these portions in place against any displacing tendency arising due to the molding procedure.

5. The method claimed in claim 4, in which the outsole is molded from uncured rubber bisquits at elevated temperature and pressure, and in which the cement is a rubber-based cement compatible with the outsole rubber.

6. The method claimed in claim 1, in which the prime rib tape follows the entire edge of the insole.

7. The method claimed in claim 4, in which the reinforcing members are staples.

8. The method claimed in claim 4, in which the reinforcing members are nails.

9. The method claimed in claim 1, in which the prime rib tape is applied "breast to breast" without entering the heel area and in which, at a point subsequent to the stapling but prior to the molding step, (a) the item of footwear is heel seat lasted to secure the heel portion of the upper to the insole by nails, and (b) reinforcing means are applied to the front of the toe through the lower free edge and into the insole, in order to retain the front and back portions in place against any displacing tendency arising due to the molding procedure.

* * * * *